US005638996A

United States Patent [19]

Montaner et al.

[11] Patent Number: 5,638,996

[45] Date of Patent: Jun. 17, 1997

[54] PRECOMPRESSION PUMP SPRAYER

[75] Inventors: Pedro Parés Montaner; Victor Ribera Turró, both of Barcelona, Spain

[73] Assignee: Monturas S.A., Barcelona, Spain

[21] Appl. No.: 740,079

[22] Filed: Oct. 24, 1996

Related U.S. Application Data

[63] Continuation of Ser. No. 422,306, Apr. 13, 1995, abandoned.

[51] Int. Cl.[6] ..... B67D 5/42

[52] U.S. Cl. ..... 222/321.2; 222/321.9

[58] Field of Search ..... 222/321.1, 321.2, 222/321.3, 321.7, 321.9, 341, 375, 382, 383.1, 385; 239/333

[56] References Cited

U.S. PATENT DOCUMENTS

| | | | |
|---|---|---|---|
| 4,051,983 | 10/1977 | Anderson . | |
| 4,228,931 | 10/1980 | Ruscitti et al. . | |
| 4,245,967 | 1/1981 | Busselet . | |
| 4,274,560 | 6/1981 | Cater | 222/321.2 |
| 4,694,976 | 9/1987 | Schuetz | 222/385 X |
| 4,856,677 | 8/1989 | Brunet et al. . | |
| 4,941,595 | 7/1990 | Montaner et al. . | |
| 4,960,230 | 10/1990 | Marelli . | |
| 5,038,965 | 8/1991 | Cater | 222/321.9 X |
| 5,234,135 | 8/1993 | LaFosse et al. . | |
| 5,482,188 | 1/1996 | Lina | 222/321.2 |

FOREIGN PATENT DOCUMENTS

| | | |
|---|---|---|
| 1529773 | 3/1977 | United Kingdom . |

*Primary Examiner*—Andres Kashnikow
*Assistant Examiner*—Kenneth Bomberg
*Attorney, Agent, or Firm*—Watson Cole Stevens Davis, P.L.L.C.

[57] ABSTRACT

A precompression pump sprayer comprises a hollow piston and a plunger rod having a discharge passage and a lower enlarged end forming a discharge valve seat, the rod extending through the piston for reciprocation between an inactive position and an end-of-stroke position, the piston engaging the valve seat in a discharge closed position, a primary spring biasing the plunger rod toward its inactive position, and a secondary spring biasing the piston into engagement with the discharge valve seat, the valve seat being of conical or curved shape, and the piston having a shoulder defining a discharge valve for solely contacting the valve seat along a thin circular line without sliding for quickly and cleanly valving the discharge passage open and closed during plunger actuation.

4 Claims, 3 Drawing Sheets

FIG. 3
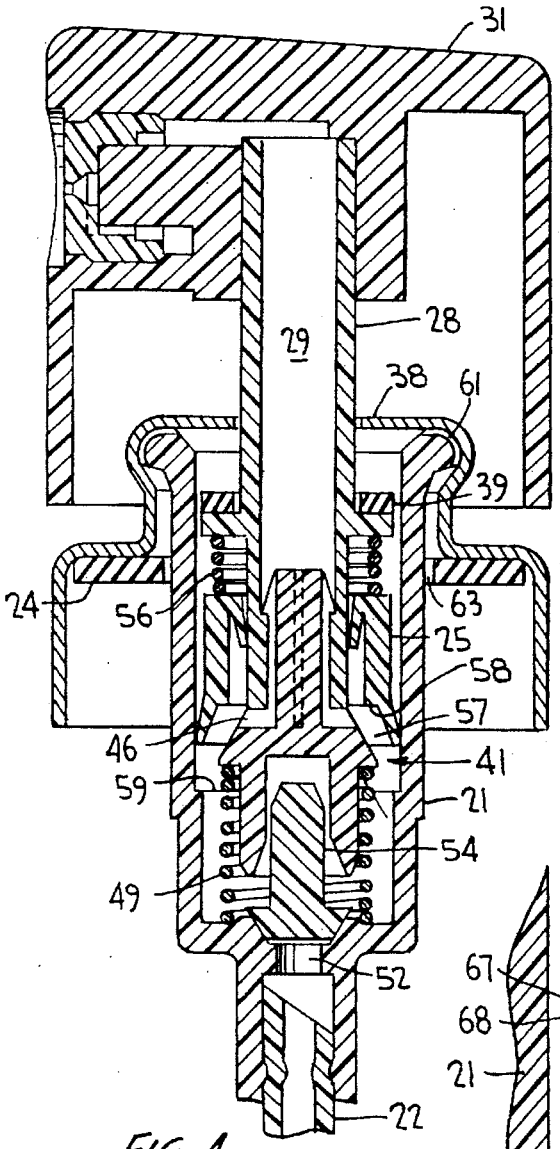
FIG. 5
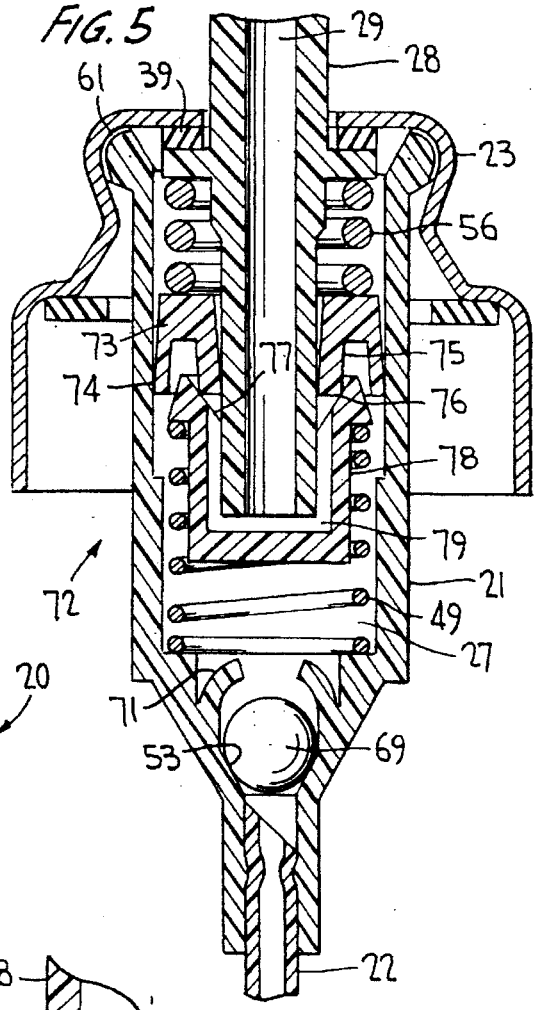
FIG. 4
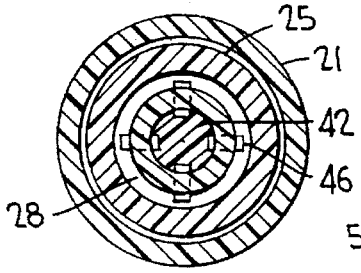
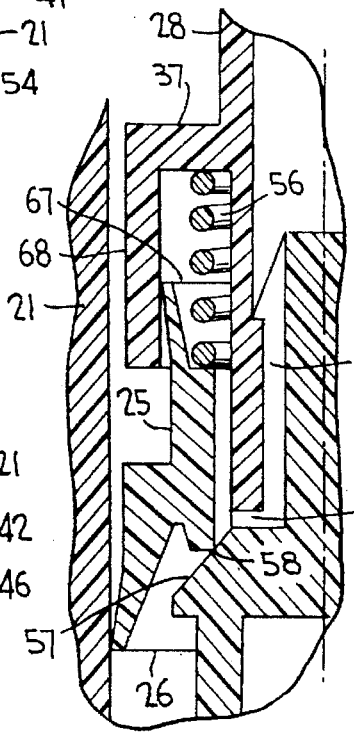
FIG. 7

PRECOMPRESSION PUMP SPRAYER

This application is a continuation of application Ser. No. 08/422,306 filed Apr. 13, 1995 now abandoned.

BACKGROUND OF THE INVENTION

This invention relates generally to a precompression pump sprayer of the type wherein a plunger rod having a discharge passage and an enlarged discharge valve seat at its lower end extends through a reciprocable piston located in the pump cylinder for sliding movement between an inactive position and an end-of-stroke position. The piston engages the valve seat in a discharge closed position and moves out of engagement with the valve seat in a discharge open position. A primary spring biases the plunger rod toward its inactive position, and a secondary spring extends between the piston and a projection on the plunger rod for transmitting movement of the plunger rod to the piston, the secondary spring having a predetermined spring force for biasing the piston toward the discharge closed position. During pump actuation, the discharge passage opens when the pump chamber pressure exceeds the force of the secondary spring.

More particularly, the present invention relates to an improvement over prior art structures of this general type by the provision of a quick acting discharge valve which avoids frictional engagement between the valve seat on the plunger rod and the piston which acts as a valve, to thereby effect more precise precompression values which avoids the dispensing of fluids at low pressures thereby avoiding dribbles, drips and drooling of product out of the discharge orifice.

Precompression pump sprayers of the general type characterized above enjoy widespread use for the fine mist spraying of liquids such as perfumes and colognes as well as may other personal care products. One of the features of the pump is to have a relatively short overall dimension, comparable in size to that of a perfume package having no pump sprayer, i.e., it is desirable for the pump sprayer to have the same cover, overcap, etc. and at the same time have its pump mechanism not visible through the glass or plastic bottle at its neck, similar to that of a package without a pump. To achieve this objective, and because the inner diameter of the typical bottle neck for such a package is of limited size, it is important to achieve maximum optimization of the height dimension of each element of the pump sprayer.

One of the many drawbacks associated with the use of non-precompression pump sprayers is its inability to quickly shut off the discharge at the end of the pressure stroke, thereby causing residual product to be discharged in dribbles and drips.

U.S. Pat. No. 4,051,983 is a precompression pump sprayer having a single piston return spring, and a conical discharge valve seated within the piston with the result that a highly acceptable fine mist spray is discharged without producing dribbles and drips or drooling on discharge shut-off.

However, the degree of precompression cannot be separately adjusted, and the precompression force varies during piston travel so that the finger force required for actuation is high. Moreover, the output of the pump in relation to the length of the stroke is low, and the pump dimensions are large in relation to the output.

U.S. Pat. No. 4,856,677 discloses a precompression pump sprayer with two springs. The overall height of the pump is low, and the full stroke is converted in output. Reduced finger force is required for pump actuation, and the two springs act in opposed relation rendering the precompression force reasonably constant during piston travel.

However, an annular seal at the lower end of the piston requires a relative sliding of the plunger rod to cover and uncover a lateral discharge port for controlling the discharge. Such an arrangement gives rise to the production of dribbles and drips and even drooling at the beginning of each pressure stroke.

U.S. Pat. No. 4,941,595, commonly owned herewith, discloses a precompression pump sprayer having a secondary cylinder affixed to the pump piston for housing a secondary piston/discharge valve mounted for sliding movement, and a secondary spring urging the secondary piston toward a discharge valve closing position.

This pump sprayer requires a low force to actuate due to the constant precompression during the stroke. A highly satisfactory fine mist spray is effected without producing dribbles and drips or drooling as abrupt and clean discharge shut off is effected by the provision of the conical discharge valve.

A wide range of products can be effectively sprayed by this known sprayer adapting the characteristics of the liquid to be sprayed by changing the secondary spring. Viscous products and gels can therefore be effectively sprayed.

However, a relatively large pump cylinder is required to accommodate the secondary cylinder.

U.S. Pat. No. 5,234,135 is similarly structured to that of the U.S. Pat. No. 4,856,677 in that frictional relative sliding movement is required between the plunger rod and the piston for covering and uncovering lateral discharge ports to control the discharge. Two springs are utilized independently, and a suck-back feature is added.

The pump requires a low force to actuate and has relatively short overall dimensions. The suck-back system at the end of the plunger stroke introduces a vacuum in a second inner chamber for avoiding the formation of dribbles and drips at the discharge orifice.

However, the frictional sliding movement necessitated between the plunger rod and the piston for controlling the discharge impedes a rapid and complete shutoff of the discharge giving rise to the production of dribbles, drips, drooling or even a reduced quality in spray. Although such prior art sprayer could be adapted to different products, in practice the range is reduced because of the low quality spray (i.e., jet) production.

SUMMARY OF THE INVENTION

It is therefore an object of the present invention to provide a precompression pump sprayer having dual springs which enhance the precompression values while avoiding the disadvantages of the known prior art pump sprayers by the provision of a quick acting and clean discharge shut off without the need for a suck-back feature, and having relatively short overall dimensions. The present pump requires a low force to actuate and produces a high quality fine mist spray without the production of dribbles and drips or drooling at the beginning or end of the pressure stroke.

A conical (or spherical or parabaloid-shaped) discharge valve seat, and a discharge valve on the piston having a sharp circular edge bearing against the conical valve seat along a circular line without sliding, effectively control the discharge without leakage through its orifice at the beginning or end of its pressure strokes. A wide range of products can be effectively sprayed as the pump can be adapted to its characteristics by changing the secondary spring. Because of the improved spray, less product remains at or near the discharge orifice, thereby avoiding the need for a suck-back feature.

Other objects, advantages and novel features of the invention will become apparent from the following detailed description of the invention when taken in conjunction with the accompanying drawings.

BRIEF DESCRIPTION OF THE DRAWINGS

FIG. 3 is a view similar to FIG. 1 of the pump sprayer at the plunger end-of-stroke position during pumping operation;

FIG. 4 is a sectional view taken substantially along the line 4—4 of FIG. 1;

FIG. 5 is a vertical sectional view of part of a precompression pump sprayer according to another embodiment of the invention; and FIGS. 6, 7, 8, 9 and 10 are vertical sectional views of relevant portions of the precompression pump sprayer according to other embodiments of the invention.

DETAILED DESCRIPTION OF THE INVENTION

Figure 1:
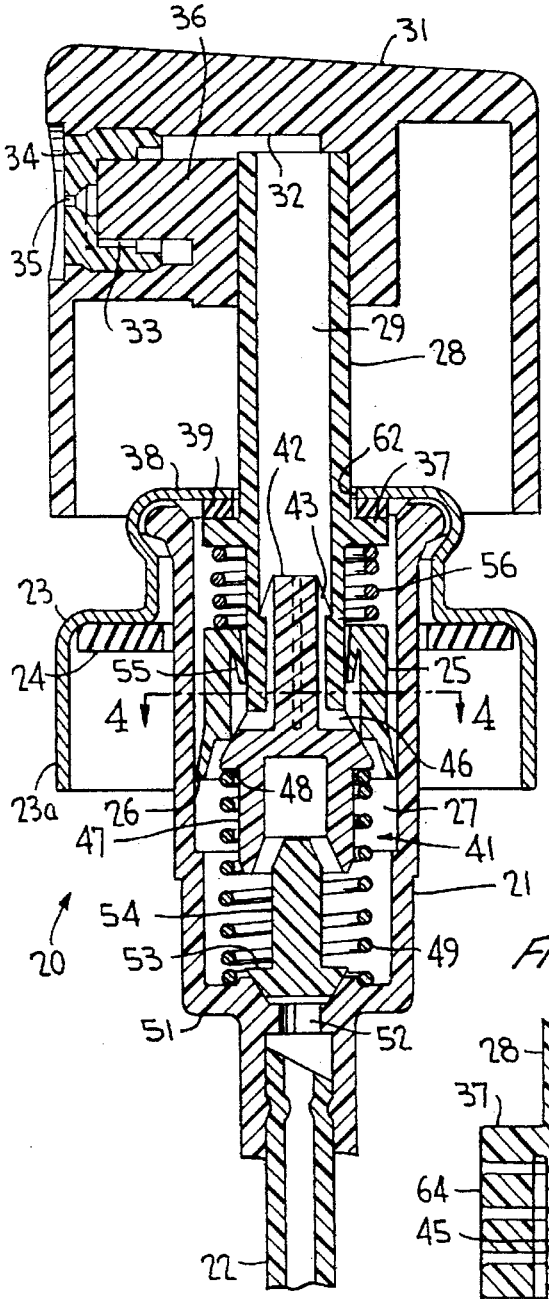
FIG. 1 is a vertical sectional view of one embodiment of the precompression pump sprayer according to the invention shown in its inactive position.
Figure 2:
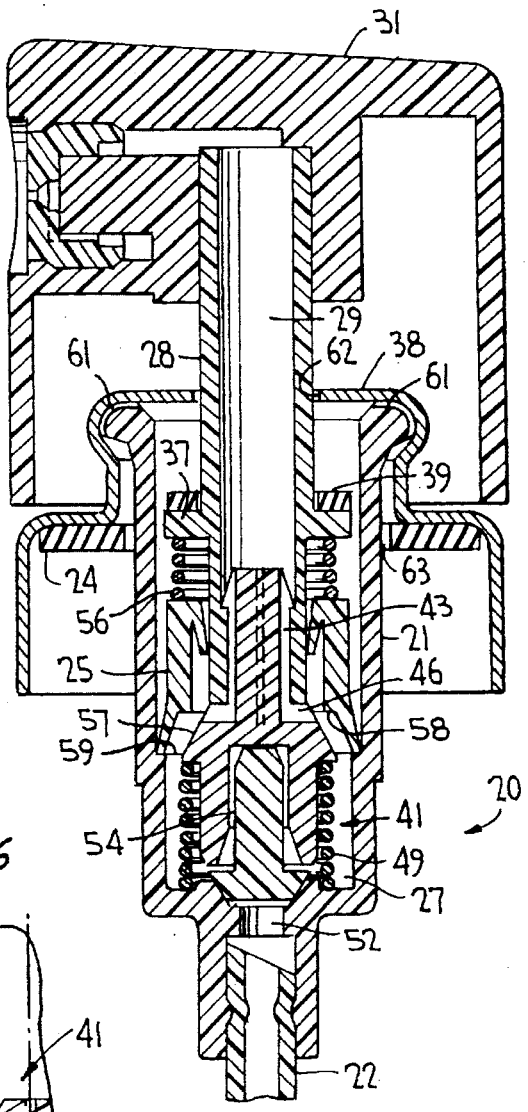
FIG. 2 is a view similar to FIG. 1 of the pump sprayer at the plunger end-of-stroke position to facilitate priming.

Turning now to the drawings wherein like reference characters refer to like and corresponding parts throughout the several views, one embodiment of the pump sprayer of the invention, generally designated 20 in FIGS. 1 to 3, comprises a pump body which includes a pump cylinder 21 supporting a dip tube 22 extending into a container (not shown) of product to be sprayed. The pump body is mounted on the container neck (not shown) by the provision of a closure which may be in the form of a ferrule 23 crimped or otherwise snapped onto the upper end of the pump cylinder. Skirt 23*a* of the ferrule is likewise crimped over a head on the container neck for retaining the closure on the container. An annular gasket 24 is interposed between the shoulder of the cap and the upper rim of the container neck for sealing against leakage. Of course, other closures such as a threaded closure can be provided in lieu of a ferrule without departing from the invention.

A pump piston 25 is mounted within the cylinder for reciprocation, the cylindrical body portion of the piston having a depending, outwardly flaring flange or lip seal 26 in sliding sealing engagement with the inner wall of the pump cylinder and therewith defining a variable volume pump chamber 27.

A pump actuator or plunger includes a plunger rod 28 which may be hollow to form a discharge passage 29, or may otherwise have a channel or channels forming the discharge passage. The plunger rod extends through the piston for reciprocation between an inactive position shown in FIG. 1 and end-of-stroke positions shown in FIG. 2 (during priming) and shown in FIG. 3 (during pumping). An upper end of the plunger rod extends outwardly of the upper end of the pump cylinder and has mounted thereon a plunger cap 31 of known construction as having a discharge channel 32 communicating with the discharge passage channels 33 of the discharge orifice cup 34 having a discharge orifice 35 containing spin mechanics and mounted on a discharge probe 36 for pulverizing the liquid during pumping to effect a fine mist spray.

The plunger rod has a laterally extending annular flange 37 underlying an upper wall 38 of the closure, an annular gasket seal 39 being interposed between wall 38 and flange 37 and being secured to the latter.

An enlarged plug element 41 is plugged into the lower end of the plunger rod, the plug having an upstanding probe 42 containing discharge channels 43 and an outer ledge 44 (see FIG. 6) which snap fits together with an inner ledge 45 formed on rod 28.

Element 41 has laterally extending discharge ports 46, and a depending sleeve or hollow extension 47 projecting from a shoulder 48 into the pump chamber.

A primary spring, which may be in the form of a coil spring 49, extends between bottom wall 51 of the pump cylinder and shoulder 48 for spring biasing the plunger toward its inactive position of FIG. 1.

Bottom wall 51 of the cylinder has an inlet port 52 and an inlet valve seat 53 against which a shuttle valve 54 is seated for controlling the inlet. The shuttle valve is guided within sleeve 47 during the plunger downstroke positions of FIGS. 2 and 3, and during the plunger return.

The piston has a downwardly flaring inner lip seal 55 at its upper end in sliding sealing engagement with the outer surface of the plunger rod. The lower inner end of the body portion of the piston is urged into tight sealing engagement with the plug element by the provision of a secondary spring, which may be in the form of a coil spring 56, extending between flange 37 and the upper wall of the piston.

Element 41 has a conical wall 57 forming a discharge valve seat. Discharge ports 46 may intersect with wall 57 as shown or could extend laterally through the plunger rod wall beneath seal 55, within the scope of the invention.

The lower inner end of the piston which seats against conical wall 57 comprises an annular shoulder 58 presenting a substantially sharp circular edge which solely bears against conical wall 57 along a circular line, without sliding, for quickly and cleanly valving the discharge passage open and closed during plunger actuation, as to be described in more detail hereinafter.

To prime the pump, the unwanted air in pump chamber 27 must be purged from the chamber and replaced by liquid product suctioned from the container in readiness for spraying as in any pump sprayer. The unwanted air from the pump chamber is discharged to the atmosphere through the discharge orifice as a downward finger force is applied to the plunger cap, thereby depressing the plunger rod from its FIG. 1 to its FIG. 2 position. As the plunger rod is lowered in the pump cylinder, piston 25 which is coupled thereto via secondary spring 56 is likewise lowered in cylinder 21, and because air in the pump chamber is compressible, the piston remains seated against element 41 and functions to compress the air in the pump chamber until lip seal 26 of the piston reaches a shoulder 59 formed in the pump cylinder. The shoulder presents a stop such that continued downward plunger movement relative to the piston functions to separate valve seat wall 57 away from shoulder 58 of the piston, thereby opening discharge ports 46 and permitting the compressed air to be exhausted from the pump chamber through discharge channels 43, discharge passage 29 and out through the discharge orifice via channels 32 and 33.

During the downstroke movements of the plunger, inlet shuttle valve 54 is forced against its inlet valve seat 53 for closing the inlet, and is guided within depending sleeve 47, as shown in FIG. 2. On release of the external finger force applied to the plunger head, primary spring 49 resiliently urges the plunger rod upwardly, whereupon the piston reengages with discharge valve seat 57 to close the discharge, thereby creating a sub-atmospheric pressure in pump chamber 27 which, given the atmospheric pressure in the container, functions to suction product from the container up the dip tube and into the pump chamber via the unseated inlet valve.

The plunger may need to be stroked two or three times to completely purge the unwanted air from the pump chamber while replacing the chamber with product until the pump is fully primed. During the process of pump priming and during the spraying operation to be described hereinafter, the liquid product drawn from the container into the pump chamber must be replaced by air at atmospheric pressure to avoid hydraulic lock of the piston and to prevent container collapse. The container is vented by the provision of a container vent passage which may in the form of one or more grooves 61 at the upper end of the pump cylinder, or by providing one or more vent ports in the cylinder wall at a location upwardly of the piston when located in the inactive position of FIG. 1. The container vent passage is further established by enlarging the diameter of opening 62 in upper wall 38 of the closure relative to the outer diameter of plunger rod 28 so as to present an annular gap as shown. The vent passage is still further established by enlarging the inner diameter of gasket seal 24 to present an annular gap 63 with the pump cylinder which communicates with the interior of the container.

The vent passage from outside the pump sprayer to inside the container is sealed closed in the inactive position of the pump by seal 39 being in tight sealing engagement with the underside of the upper wall 38 of the closure under the resilient spring force applied by primary spring 49. During each pressure stroke applied to the plunger, seal 39 moves away from upper wall 38, thereby opening the vent passage permitting air under atmospheric pressure to enter the container to replace product drawn into the pump chamber during each ensuing suction stroke.

Once the pump is fully primed, application of external finger force to the plunger depresses the plunger rod which begins to lower the piston in the cylinder, and since liquid is incompressible, the filled pump chamber is quickly pressurized reaching a threshold pressure. Once this threshold pressure is reached, and exceeds the return force of secondary spring 56, the piston disengages from element 41 to open the discharge as ports 46 are opened as shown in FIG. 3. Product is therefore discharged under pressure through the orifice while the inlet valve is forced closed. As soon as the threshold pressure in the pump chamber is overcome by the opposing force of secondary spring 56, due to the below atmospheric pressure in the pump chamber, the piston immediately reengages with element 41 to close the discharge. The plunger rod is returned to its FIG. 1 position under the action of primary spring 49, whereupon the reduced pressure in the pump chamber functions to suction product from the container into the pump chamber via the open inlet valve.

The opening and closing of the discharge, according to the invention, is quick and abrupt and takes place without any sliding which would cause friction resistance on engagement with the valve seat since the discharge valve is defined by a clean circular edge of shoulder 58 contacting conical wall 57 along a thin, circular line. The piston and/or the plug element 41 can be of relatively soft plastic compared to that of the plunger rod and other plastic elements of the pump. The circular line valve contact with conical wall 57 functions to multiply the spring force of the secondary spring 56 producing a more precise precompression value in avoiding dribbles, drips and drooling of product out of the discharge orifice upon each closing of the discharge valve. In the present system, the equilibrium maintained between the secondary spring 56 and the pump chamber pressure during each pressure stroke is overcome quickly and cleanly as the discharge is valved open immediately upon disengagement between shoulder 58 and wall 57 without any sliding or frictional drag resulting during discharge valve opening. Likewise, each time the discharge valve is closed, upon reengagement between 58 and 57, the shutoff is abrupt and complete without any sliding or gradual closing of the discharge ports 46. Thus, at the beginning and end of each pumping stroke, any leakage of product out of the orifice or the formation of dribbles or drips is avoided, thereby ensuring the discharge of a high quality fine mist spray.

Figure 6:
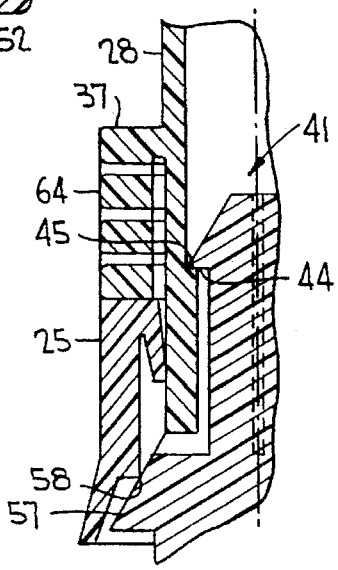

Besides, during pump operation, piston travel during its reciprocation is quite short given the relatively slight movement required between its valve shoulder and the discharge valve seat to control the discharge. The limited travel of the piston thus gives rise to the provision of a substitute secondary spring, which, as shown in FIG. 6, can be made integral with flange 37 of the plunger rod and bearing directly against the upper wall of piston 25. Thus, spring 64 is substituted for metal coil spring 56, thereby saving a part for assembly of the pump sprayer.

As in the aforementioned U.S. Pat. No. 4,941,595, secondary spring 56 may be selected in each case depending on the higher or lower degree of precompression desired for the pump. And, primary spring 49 may be selected depending on the greater or lesser viscosity of the liquid to be pumped, and depending on the desired hard or soft touch preferred for the pump. Although integral spring 64 cannot be readily replaced by itself for desired precompression values, the primary and secondary springs, whether separate parts or integral, are completely independent, such that compression of the primary spring depends only on the force applied to the plunger without any influence by the secondary spring.

Figure 1A:
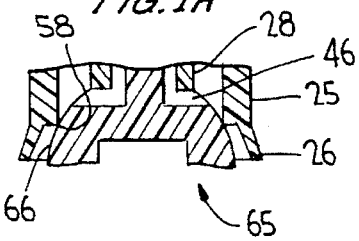
FIG. 1A is a vertical sectional view of an alternate discharge valve seat for carrying out the invention.

The valve seat formed on plug element 41 of the invention can, as described, be defined by conical wall 57 but is not limited to such shape. For example, plug element 65 of FIG. 1A, which is essentially the same as plug element 41 described above, instead has a curved wall 56 defining the discharge valve seat, without departing from the invention. Shoulder 58 forming the discharge valve on the piston thus likewise engages curved wall 66 along a thin circular line. Curved wall 66 may be spherical or may be formed as a paraboloid of revolution. Either shape and any other equivalent shape generates a circular line contact therewith in the discharge closed position upon engagement by the sharp inner circular edge 58 of the piston.

In the FIG. 7 embodiment, piston 25 has, instead of an inner lip seal 55, an outwardly and upwardly flaring lip seal 67 in sliding sealing engagement with a skirt 68 depending from flange 37 on the plunger rod. Secondary spring 56 is, however, exposed to the product when discharged through the open discharge valve.

The inlet check valve can be other than a shuttle valve, such as a ball check valve 69 shown in FIG. 5. One or more fingers 71 formed at the bottom wall of the pump cylinder loosely surround the ball valve to present a valve cage for containing the ball valve when unseated during each suction stroke. Of course, other one-way inlet check valves are made possible for use in carrying out the invention, such as a flap valve, etc.

The aforedescribed discharge valve seat slopes in a direction toward the pump chamber (internal slope) although the valve seat can slope in a direction away from the pump chamber (external slope) without departing from the invention. A standard sloping angle (from the horizontal) could be 60°, but could likewise be 45° or 30°, whether internal or external. Element 41 may need to be of even softer plastic material to assure tightness in the discharge valve closing position when the angularity of the internal or external cone is 30° and less.

Pump sprayer 72 of FIG. 5 includes a piston 73 of substantially U-shaped cross-section with a pair of depending annular lip seals 74 and 75. Seal 74 flares outwardly for sliding sealing engagement with the inner wall of the pump cylinder, and seal 75 flares inwardly for sliding sealing engagement with the outer surface of plunger rod 28. The outer lower shoulder 76 of seal 75 presents a sharp circular edge forming a discharge valve for engagement with conical wall 77 forming a valve seat. This so-called external valve seat is formed at the inner surface of a cup-shaped element 78 affixed to the lower end of the plunger rod, element 78 having one or more channels 79 establishing communication between pump chamber 27 and discharge passage 29 in the discharge valve open position.

The pump operates essentially the same as described with reference to the FIGS. 1 to 4 embodiment, although the conical valve seat, in the valve closed position, applies an inward lateral force to lip seal 75 for enhancing the seal against the plunger rod.

Also, with this embodiment, the piston has less of a projected surface exposed to the pump chamber pressure for opening the valve, such that a softer secondary spring 56 may be required. And, the threshold pressure at which the secondary spring force is overcome to open the valve may need to be higher when spraying difficult liquids such as those with higher viscosities.

Figure 8:
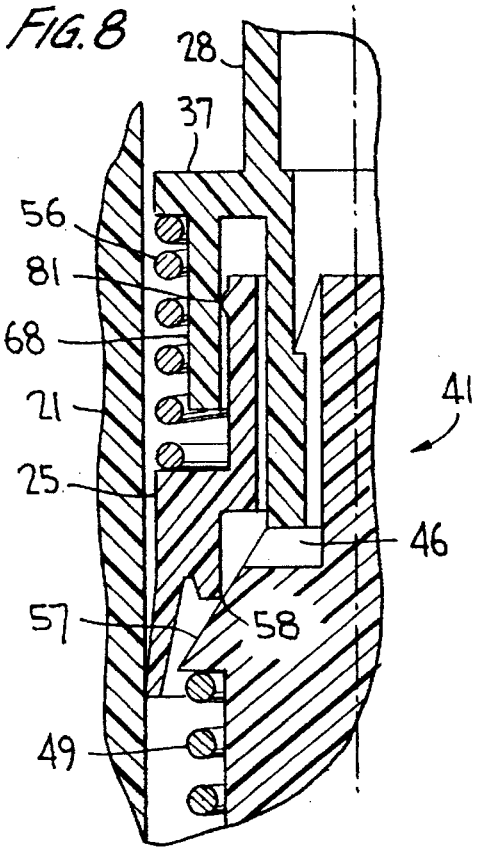

The FIG. 8 embodiment is similar to that of FIG. 7 except that secondary spring 56 is external to skirt 68, and lip seal 67 is substituted by an annular external seal bead 81 in sliding sealing engagement with the inner surface of skirt 68, thereby reducing the spacing between skirt 68 and the plunger rod to accommodate external spring 56.

Figure 9:
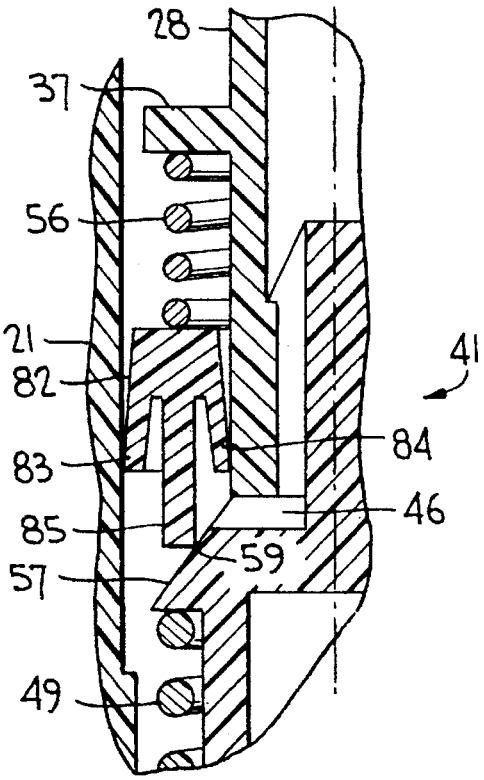

In the FIG. 9 embodiment, piston 82 is substantially T-shaped in cross-section, having a pair of lip seals 83 and 84 extending from opposite sides of sleeve portion 85. The lower inner edge of sleeve 85 defines the sharp edge of shoulder 59 acting as the discharge valve. Lip seal 83 flares downwardly and outwardly in sliding sealing engagement with the inner wall of the cylinder, and lip seal 84 flares downwardly and inwardly sliding sealing engagement with the outer surface of the plunger rod.

Figure 10:
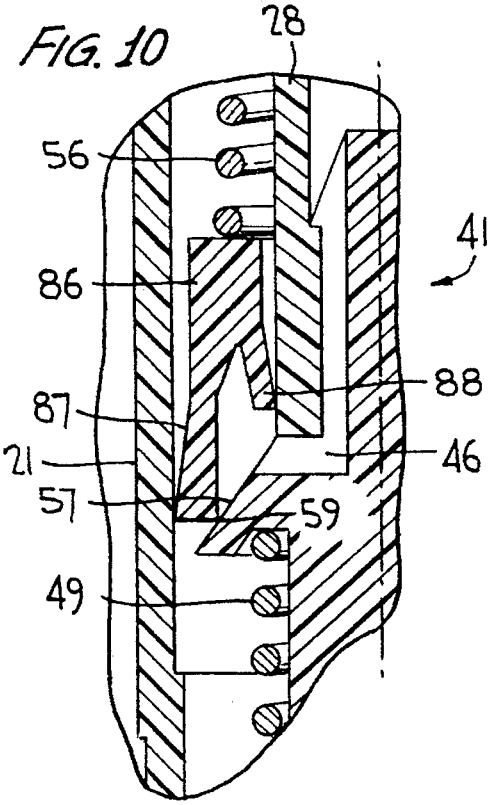

In the FIG. 10 embodiment, pump piston 86 is substantially U-shaped in cross-section, having a pair of lip seals 87 and 88. Lip seal 87 flares downwardly and outwardly in sliding sealing engagement with the inner wall of the pump cylinder, and its lower inner edge forms shoulder 59 which defines the discharge valve of the invention. The other lip seal 88 flares downwardly and inwardly for sliding sealing engagement with the outer wall of the plunger rod.

Each of the aforedescribed embodiments, of course, are operated in substantially the same manner as described with reference to the FIGS. 1 to 4 embodiment.

Terms of orientation, such as "upper," "lower," "top" and "bottom," are used herein for purposes of clarity to identify the orientation relative to the drawings. Such terms are not intended to limit the scope of this invention or to exclude and equivalent structure.

Obviously, many other modifications and variations of the present invention are made possible in the light of the above teachings. It is therefore to be understood that within the scope of the appended claims the invention may be practiced otherwise than as specifically described.

What is claimed is:

1. A pump sprayer, comprising:

a pump body including a cylinder having a valve controlled inlet at a lower end thereof;

a piston reciprocable in said cylinder for therewith defining a variable volume pump chamber;

a plunger rod having a discharge passage and a lower enlarged end forming a discharge valve seat, an upper end of said rod extending outwardly of an upper end of said cylinder, said rod extending through said piston for reciprocation between an inactive position and an end-of-stroke position;

said piston engaging said valve seat in a discharge closed position and being out of engagement with said valve seat in a discharge open position;

primary spring means for biasing said plunger rod toward the inactive position;

secondary spring means extending between said piston and a projection provided on said plunger rod for transmitting movement of said plunger rod to said piston, said secondary spring means having a predetermined spring force for biasing the piston toward said discharge closed position when said force exceeds pump chamber pressure, said piston being moved to said discharge open position when the pump chamber pressure exceeds said spring force;

said discharge valve seat comprising a conical wall sloping in an outward direction away from the pump chamber so as to form an acute angle with said plunger rod;

said piston being substantially U-shaped in cross-section comprising a pair of depending spaced annular lip seals, one of said lip seals comprising a piston seal in sliding sealing engagement with an inner wall of said cylinder, the other of said lip seals defining an annular seal in sliding engagement with said plunger rod, and said other lip seal further defining an annular shoulder forming a sharp circular edge for solely contacting said conical wall along a circular line without sliding for quickly and abruptly valving the discharge passage open and closed during plunger actuation.

2. The pump sprayer according to claim 1, wherein said discharge passage at said one end of said plunger rod terminates in a plurality of discharge channels intersecting said conical wall.

3. The pump sprayer according to claim 1, wherein said enlarged end forming said discharge valve seat comprises a cup element coupled to said one end of said plunger rod, said cup element having discharge channels communicating with said discharge passage.

4. The pump sprayer according to claim 1, wherein said secondary spring means comprises a coil spring integral with said plunger rod.

* * * * *